US011441383B2

(12) United States Patent
Hughes

(10) Patent No.: US 11,441,383 B2
(45) Date of Patent: Sep. 13, 2022

(54) ANNULAR PRESSURE CONTROL DIVERTER

(71) Applicant: Hughes Tool Company LLC, Highlands Ranch, CO (US)

(72) Inventor: William James Hughes, Highlands Ranch, CO (US)

(73) Assignee: Hughes Tool Company LLC, Highlands Ranch, CO (US)

( * ) Notice: Subject to any disclaimer, the term of this patent is extended or adjusted under 35 U.S.C. 154(b) by 0 days.

(21) Appl. No.: 17/374,113

(22) Filed: Jul. 13, 2021

(65) Prior Publication Data

US 2022/0018209 A1 Jan. 20, 2022

Related U.S. Application Data

(60) Provisional application No. 63/051,837, filed on Jul. 14, 2020.

(51) Int. Cl.

| | |
|---|---|
| ***E21B 33/128*** | (2006.01) |
| ***E21B 33/06*** | (2006.01) |
| ***E21B 33/038*** | (2006.01) |
| ***E21B 33/068*** | (2006.01) |

(52) U.S. Cl.

CPC ..... *E21B 33/1285* (2013.01); *E21B 33/06* (2013.01); *E21B 33/061* (2013.01); *E21B 33/038* (2013.01); *E21B 33/068* (2013.01)

(58) Field of Classification Search

CPC .... E21B 33/1285; E21B 33/06; E21B 33/061; E21B 33/068; E21B 33/038

See application file for complete search history.

(56) References Cited

U.S. PATENT DOCUMENTS

| | | | | |
|---|---|---|---|---|
| 930,758 A * | 8/1909 | Hughes | E21B 10/08 175/376 |
| 1,569,247 A | 4/1922 | Abercrombie et al. | |
| 4,511,168 A * | 4/1985 | Haynes | E21B 19/10 188/67 |
| 4,579,314 A * | 4/1986 | Schaeper | E21B 33/06 251/1.2 |
| 5,009,565 A * | 4/1991 | Esau | B66F 9/187 294/206 |

(Continued)

FOREIGN PATENT DOCUMENTS

| | | |
|---|---|---|
| CA | 2658997 A1 * | 1/2008 |
| WO | WO2021/118895 A1 | 6/2021 |

*Primary Examiner* — Jonathan Malikasim

(74) *Attorney, Agent, or Firm* — Michael D. Reilly

(57) ABSTRACT

Disclosed herein are various embodiments of an Annular Pressure Control Diverter designed to be positioned below the conventional blowout preventer stack, and which will be activated during near balanced drilling operations to seal the annulus between the drill pipe and the production casing. Returned drilling fluid and produced fluids are diverted up the annulus between the production casing and intermediate casing and through a well head located below an all-inclusive BOP stack. The Annular Pressure Control Diverter does not rotate, and some embodiments have an elliptical internal cavity which ensures that the elliptical seals cannot rotate. Doors are provided on each side of the Annular Pressure Control Diverter to permit changing of the seal elements. Door locking mechanisms are provided for operator safety.

2 Claims, 11 Drawing Sheets

(56) References Cited

U.S. PATENT DOCUMENTS

| | | | | |
|---|---|---|---|---|
| 7,487,839 | B2 * | 2/2009 | Boscher | E21B 33/068 166/379 |
| 9,175,542 | B2 * | 11/2015 | Bailey | E21B 33/06 |
| 9,540,898 | B2 * | 1/2017 | Hughes | E21B 33/08 |
| 9,732,577 | B2 * | 8/2017 | Holland, Jr | E21B 33/062 |
| 9,957,774 | B2 * | 5/2018 | Clark | E21B 33/085 |
| 9,963,951 | B2 * | 5/2018 | Arteaga | E21B 33/06 |
| 10,190,378 | B2 * | 1/2019 | Alajbegovic | E21B 33/03 |
| 11,255,144 | B2 * | 2/2022 | Hughes | E21B 33/047 |
| 2020/0362647 | A1 * | 11/2020 | Folwark | E21B 19/10 |
| 2021/0172273 | A1 * | 6/2021 | Hughes | E21B 33/085 |

* cited by examiner

ANNULAR PRESSURE CONTROL DIVERTER

CROSS REFERENCE TO RELATED APPLICATIONS

This application claims the benefit under 35 USC § 119 (e) of U.S. Provisional Patent Application No. 63/051,837, entitled "Annular Pressure Control Diverter" to William James Hughes, filed on Jul. 14, 2020, which is hereby incorporated by reference in its entirety.

This application is related to U.S. Provisional Patent Application No. 62/945,210, "Annular Pressure Cap Drilling" to William James Hughes, filed on Dec. 8, 2019, which is hereby incorporated by reference in its entirety.

This application is related to U.S. Utility patent application Ser. No. 17/113,005, Publication No. US 2021/0172273, entitled "Annular Pressure Cap Drilling Method", filed on Dec. 5, 2020, which is hereby incorporated by reference in its entirety.

This application is related to PCT Patent Application PCT/US2020/063522, Publication Number WO2021/118895, entitled "Annular Pressure Cap Drilling Method", filed on Dec. 6, 2020, which is hereby incorporated by reference in its entirety.

This application is related to U.S. Provisional Patent Application No. 63/082,059, entitled "Annular Pressure Control Ram Diverter" to William James Hughes, filed on Sep. 23, 2020, which is hereby incorporated by reference in its entirety.

FIELD

Various embodiments described herein relate to drilling oil and gas wells, and devices, systems and methods associated therewith.

BACKGROUND

The following descriptions and examples are not admitted to be prior art by virtue of their inclusion within this section.

When the first commercial oil wells were drilled, they were drilled to relatively shallow depths using cable tools which mechanically removed cuttings from the wellbore. Even then, the operators sometimes hit high pressure oil or gas pockets, resulting in dangerous and wasteful blowouts as the hydrocarbons escaped up the well bore. Rotary drilling was introduced in the early 1900s. See U.S. Pat. No. 930,758 to H. R. Hughes, entitled "Drill". The original Hughes Tool company's roller cone bit design forever changed how the oil and gas industry drilled wells. The rotary drill bit allowed much deeper wells to be drilled, and as the wells became deeper, the pressures encountered rose rapidly.

Rotary drilling required the circulation of drilling fluid down the drill pipe and back up the annulus between the drill pipe and the casing to lubricate and cool the drill bit and to remove the cuttings from the bottom of the well.

When conventional drilling methods are used to drill for oil and gas, precautions must be taken to avoid "blowouts", that is, the dangerous condition where the drill bit encounters a subsurface formation containing hydrocarbons under high pressure. In the early days of drilling for oil and gas, not only could a blowout send large amounts of oil or gas to the surface, the entire rig would sometimes catch fire. The industry quickly developed methods of drilling which prevented this type of disaster, and devices to increase safety and efficiency.

Rotary drilling, in combination with a heavy drilling fluid, was one such approach which quickly gained acceptance. By increasing the density of the drilling fluid, the total weight of the column of drilling fluid could be made to exceed the expected pressure of any hydrocarbon pockets, thus preventing blowouts. This technique was and is known as "overbalanced" drilling. As the well was drilled deeper, different formations with different fluid pressures would be encountered. It was the responsibility of the mud engineer to constantly monitor the pressures and adjust the density of the drilling fluid so that the weight of the column of mud in the wellbore exerted a pressure on the rock formation being drilled which exceeded the predicted pressure of any hydrocarbons contained within the formation. This technique has been shown to be effective in preventing blowouts caused by hitting zones of high pressure oil or gas. If the fluid was too light, blowouts could occur, but if it was too heavy, the cuttings would not efficiently be removed from the area in front of the drill bit and thus the rate of drilling would slow.

The technique is not entirely risk-free, as the "mud engineer" responsible for adjusting the density and total mud weight must be constantly monitoring the process, and mistakes can be made, resulting in blowouts. Additional protection is therefore provided for the workers on the rig floor by installing various devices to prevent the sudden and dangerous release of hydrocarbons under high pressure.

These mechanical barriers include blowout preventers which include, various types of hydraulic rams which can be closed to seal off the well bore annulus, diverters to direct high pressure flow away from the rig, and others. See, for example, U.S. Pat. No. 1,569,247 to Abercrombie et al., entitled "Blow-out Preventer", for an early version of one of these devices. Several of these devices are usually installed above the wellhead in what is referred to as a "stack" or a "BOP stack". A typical stack consists of between one and six ram-type blowout preventers, and usually, one or two annular blowout preventers. Some of these devices are employed routinely when performing normal drilling operations, such as changing a drill bit. Others are used in emergencies, as a last resort, to prevent accidents and disasters.

The heavy drilling mud prevents hydrocarbons from entering the well bore and reaching the surface because the pores and fractures in the rocks rapidly become plugged with drilling fluid which was forced in under pressure, and often drawn further in by capillary action, thereby reducing the effective permeability to zero. It has been said that Howard Hughes not only invented the rotary drill bit, he inadvertently invented formation damage. That may be giving too much credit to Howard Hughes, but it remains true that the goal of all drilling engineers for many years seems to have been to inflict the maximum possible formation damage and prevent the release of any hydrocarbons whatsoever during the drilling process.

Once the drilling was completed within the target hydrocarbon bearing formation, the goal of the completion engineer was totally opposite to the goal of the drilling engineer. The completion engineer always tries to achieve the maximum possible flow of hydrocarbons, which required the least possible formation damage by restoring the maximum possible porosity and permeability. These goals are hard to accomplish when the pores and fractures have been plugged by drilling mud. The proposed solution in many cases was the use of hydraulic fracturing, referred to as "fracing" within the oil and gas industry and "fracking" in the popular media. Fracing is often said to be necessary to fracture rocks which have few natural fractures. The reality is that all rocks contain natural fractures, some more than others. Industry insiders will sometimes admit, when pressed, that fracing is really an attempt to blast through the damaged formation and restore a path for the hydrocarbons to flow through.

Hydraulic fracturing involves pumping fluid under very high pressure into hydrocarbon-bearing rock formations to force open cracks and fissures and allow the hydrocarbons residing therein to flow more freely. The fluid is primarily water, and may contain chemicals to improve flow, and also "proppants" (an industry term for substances such as sand). In theory, when the fracturing fluid is removed, and the hydrocarbons are allowed to flow, the sand grains prop open the fractures and prevent their collapse, which might otherwise quickly stop or reduce the flow of hydrocarbons. However, many rock types react with water and expand, further reducing the possibility of producing hydrocarbons. Yet the industry continues to use water for hydraulic fracturing operations in shale formations.

For the first 100 years and more of oil exploration and production, wells were drilled almost exclusively in geologic formations that permitted production of oil and gas flowing under the natural pressures associated with the formations. Such production required that two physical properties of the geologic formation fall within certain boundaries. The porosity of the formation had to be sufficient to allow a substantial reserve of hydrocarbons to occupy the interstices of the formation, and the permeability of the formation had to be sufficiently high that the hydrocarbons could move from a region of high pressure to a region of lower pressure, such as when hydrocarbons are extracted from a formation. Many of these reservoirs had sufficient porosity and permeability to allow the flow of hydrocarbons even after the damage inflicted by overbalanced drilling.

In recent years, it has become apparent that large reserves of hydrocarbons are to be found in shale formations. The current mindset today in the upstream oil and gas industry is that unconventional reservoirs such as shales need to be hydraulically fractured because they are tight—that is, they have low porosity and permeability. That premise is contradicted by shale reservoirs such as the Monterey in California, the Pierre in Colorado and the Marcellus in New York which were so productive in the early 1900's, long before hydraulic fracturing was ever invented. These reservoirs were drilled without overbalanced mud systems, and even though they were vertical wells they still were able to encounter a small fraction of the formation's natural fracture system. Tectonically induced natural fractures initially propagate perpendicular to the bedding plane of a formation. Over time sedimentary beds with no dip can be tilted thereby also tilting the natural fracture system within the formation so that even a vertical well is able to intersect a few natural fractures. Given the high dip of many formations in California, vertical wells are technically high angle wells based on the definition of a horizontal well which is a wellbore drilled parallel to the bedding plane of a formation and not a wellbore drilled parallel to the surface of the earth.

Many early Monterey Shale wells exceeded 10,000 BOPD without fracing. This does not fit with the current doctrine that shales are too tight to produce without fracing. When most industry professionals talk about a shale reservoir being "tight" they are generally referring to the matrix, which is a correct observation. What is not considered is the permeability contribution from natural micro and macro fractures that exists in all hard (brittle) sedimentary rocks such as shales. Determination of the "collective" permeability system is important to understanding why so-called "tight" rocks can produce without being hydraulically fractured. It should be noted that a single natural fracture with an aperture of 25 microns has over 50 Darcy's of permeability.

Another trend in the last thirty years is that drilling technology has evolved to allow wells to be drilled horizontally in virtually any direction, and is no longer constrained to the drilling of vertical wells only. Deviated wells are thus often drilled horizontally through specific geologic formations to increase production potential. The extent of a hydrocarbon-producing formation in a vertical well may be measured in feet, or perhaps tens or hundreds of feet in highly productive areas. By drilling horizontally or non-vertically through a formation, the extent of the formation in contact with the wellbore can be much greater than is possible with vertically-drilled wells. Natural fractures tend to propagate in the direction of maximum stress. In formations which are essentially horizontal, the fractures tend to propagate vertically and in specific directions. Thus a horizontal well intersects the maximum number of fractures for a given distance drilled. In order to optimize the production and the useful life of the well, the natural fracture system should not be compromised by the injection of heavy drilling fluids.

What is needed are improved techniques wherein the rock formations are not damaged during the drilling process. These improved techniques will allow the production of hydrocarbons from the natural fracture systems in the rocks without the need for hydraulic fracturing. Such improved techniques will also remove the need for the millions of gallons of water, the sand, and the chemicals required by fracing operations. The improved techniques must also offer a level of safety which is at least as good, and preferably better than, traditional drilling techniques.

SUMMARY

There is provided an annular pressure control diverter for sealing an annulus between a drill pipe and a production casing surrounding the drill pipe below a blowout preventer BOP stack while rotating the drill pipe in order to divert a flow of returned drilling and produced fluids, comprising: a cylindrical body having upper and lower flanges to enable installation below the BOP stack; a flexible seal which compresses around the drill pipe; the flexible seal further comprising two interlocking flexible seal elements and two side access doors, one on each side of the cylindrical body, through which the interlocking flexible seal elements may be replaced, wherein the side access doors open on side mounted hinges and wherein the side access doors are secured by a dual horizontal hydraulic piston clamp.

Further embodiments are disclosed herein or will become apparent to those skilled in the art after having read and understood the specification and drawings hereof.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of several illustrative embodiments when read in conjunction with the accompanying drawings, wherein:

The drawings are not necessarily to scale. Like numbers refer to like parts or steps throughout the drawings.

DETAILED DESCRIPTION OF SOME EMBODIMENTS

Figure 1B:
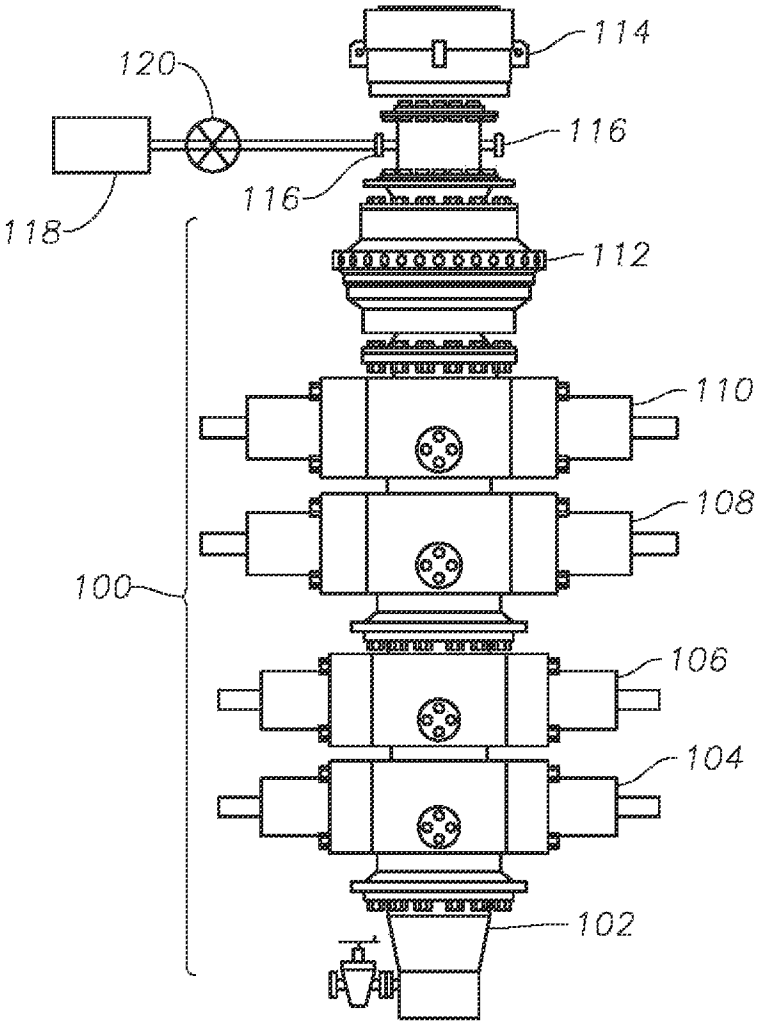
FIG. 1B (Prior Art)
FIG. 1B shows a conventional blowout preventer stack configured for underbalanced drilling operations with an RCD at the top of the stack.

In the following description, specific details are provided to impart a thorough understanding of the various embodiments of the invention. Upon having read and understood the specification, claims and drawings hereof, however, those skilled in the art will understand that some embodiments of the invention may be practiced without hewing to some of the specific details set forth herein. Moreover, to avoid obscuring the invention, some well-known methods, processes and devices and systems finding application in the various embodiments described herein are not disclosed in detail.

Referring now to the drawings, embodiments of the present invention will be described. The invention can be implemented in numerous ways. Several embodiments of the present invention are discussed below. The appended drawings illustrate only typical embodiments of the present invention and therefore are not to be considered limiting of its scope and breadth. In the drawings, some, but not all, possible embodiments are illustrated, and further may not be shown to scale.

The oil and gas industry has standards for the size of pipes and casings, and for the sizes and configurations of devices such as casing heads, blowout preventers, chokes, etc. Therefore when this specification describes such devices as being installed, one of ordinary skill in the art will understand that the devices are installed and connected using industry standard connections.

For a discussion of the issues relating to Near Balanced Reservoir Drilling, including operator safety and production while drilling, see U.S. Utility Patent Publication No. US 2021/0172273, hereinafter "the '273 Publication" which is hereby incorporated by reference in its entirety. It includes a description of how the devices disclosed in the current application are used to safely and efficiently drill for oil and gas.

The use of heavy drilling mud is referred to as "overbalanced" drilling, in that the weight of the drilling fluid in the wellbore exceeds the pressures expected to be encountered in the well. The result is that the drilling fluid is forced under pressure into the pores and fractures of the rock formations being drilled. This is not a problem while drilling through non-producing formations on the way to the target zone. From the perspective of the driller, it is still not a problem when the target zone is encountered. The drilling mud forms an effective barrier to prevent the hydrocarbons from entering the well bore while drilling is in progress. The problem is that the barrier is equally effective when drilling is complete and the well is turned over to the production engineers. The solution in many wells is to use hydraulic fracturing to try to clear the pores and fractures.

A far better approach is to not cause the formation damage in the productive formation in the first place. In order to avoid formation damage, some drilling operations are conducted using "underbalanced' or "near balanced" drilling techniques. In underbalanced drilling ("UBD"), a light drilling fluid, such as mineral oil, is used. The weight of the column of drilling fluid is then significantly less than the expected pressures which may be encountered during drilling. In near balanced reservoir drilling ("NBRD"), the weight of the drilling fluid may approach, but is never allowed to exceed, the pressures of the hydrocarbons in the target formations. The primary difference between traditional underbalanced drilling and near balanced drilling is that traditional underbalanced drilling is overbalanced in front of the drill bit. The near balanced method is underbalanced in front of the bit because the drilling technique allows no drilling fluid to exit the drill bit. Both of these approaches avoid formation damage above the bit by not forcing drilling fluid into the pores and fractures of the formation. Both techniques expect, and plan for, the production of hydrocarbons while drilling the well.

These techniques differ from what is known as "Managed Pressure Drilling" or MPD, where the weight of the column of drilling fluid is adjusted to increase penetration rates and minimize formation damage, but is kept high enough that no hydrocarbons are produced during drilling. Therefore there will inevitably be some degree of formation damage.

Some wells are drilled using overbalanced techniques for the vertical section of the well. Then as the horizontal sections are drilled out from the vertical wellbore, the heavy drilling mud is no longer used, and underbalanced or near balanced drilling is used while drilling through the producing formation. This approach has not gained wide acceptance, in part because of reluctance to adopt new techniques, and in part because of safety concerns.

These underbalanced techniques eliminate the use of the heavy drilling mud, and therefore requires an additional barrier to be positioned between the drilling rig crew and the high pressures downhole. This is usually a rotating control device (RCD) installed at the top of the BOP stack. However, this is not an ideal solution, because it means that in some drilling operations the drillers and rig crew are operating in close proximity to pressures in excess of 5,000 psi. The safe adoption of underbalanced and near balanced drilling therefore requires an alternative primary pressure barrier to prevent blowouts and to reduce the danger to the rig workers from highly pressurized equipment on the rig floor.

The present invention discloses such an alternative primary pressure barrier. The present invention is not a standard annular blowout preventer (BOP), nor is it a conventional rotating control device (RCD). It does perform some similar functions, but is intended to be used in a different manner while drilling. In order to fully appreciate the present invention, it is helpful to first discuss the different types of BOPs, annular BOPs and RCDs and how they are used.

Figure 1A:
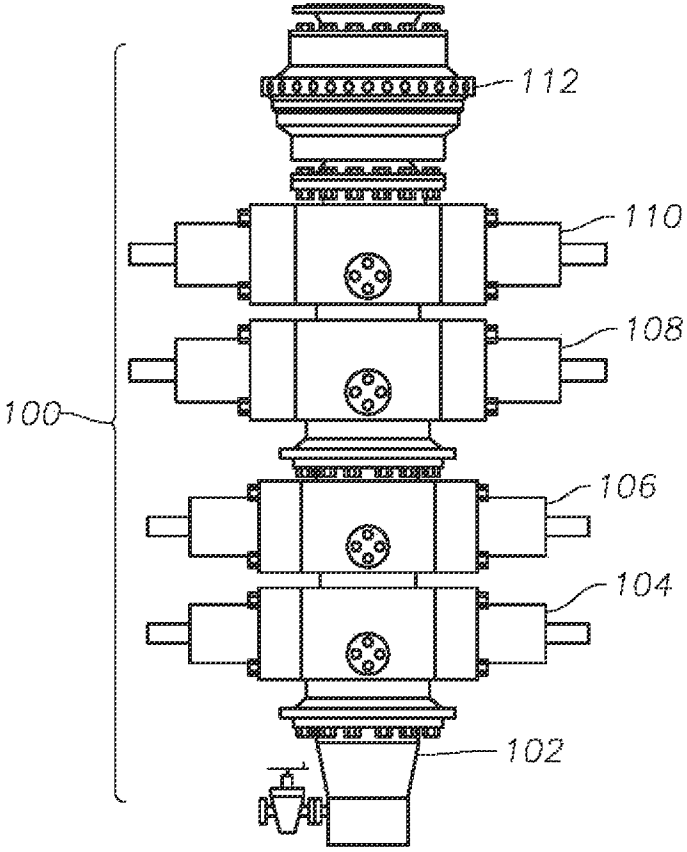
FIG. 1A (Prior Art)
FIG. 1A shows a conventional blowout preventer stack.

A typical BOP stack configuration for an overbalanced drilling operation is shown in FIG. 1A. Here the BOP stack 100 is positioned above the well head 102. During drilling operations, hydraulic ram blowout preventers may be used to close off the well for maintenance purposes, tripping the drill bit, or in case of problems. A shear ram 104 may be installed. Shear rams are used to cut through the drill pipe, and obviously are used only in emergencies or certain specific situations. One or more blind rams 106 are also installed in the stack. Blind rams close the well bore completely when no pipe is present. Pipe rams 108 and 110 close off the annulus around the drill pipe and are used when the drill pipe is still in the well.

Ram-type blowout preventers are only used when drilling operations are not in progress and depending on the type, when the drill pipe is not rotating or is not present. An annular BOP 112 is, as the name implies, intended to close off the annulus around the drill pipe. Annular BOPs are intended to be used when the drill pipe is not rotating.

When the industry began to use underbalanced drilling techniques, it was recognized that not using the drilling mud column to control blowouts created a potential hazard, and some other safety mechanism was needed to provide continuous control of the pressure in the well while drilling. The solution to this problem had to be capable of functioning while the drill pipe was present, and more significantly, while it was rotating during drilling operations. The device had to be capable of sealing off the annulus around the rotating drill pipe with pressures in the well of 1,500 psi and above. The sealing element in a conventional annular BOP would quickly wear out from the friction with the rotating drill pipe. Distortion of the seal due to the torque transferred from the drill pipe could compromise the effectiveness of the seal. Additional wear and damage would occur when tripping the drill string. No drilling engineer would allow such wear on a secondary or backup safety device, which has to work reliably when needed during well control events, and seal off high pressures in an emergency. There is therefore no question that the annular BOP cannot be used as a substitute for the primary safety barrier of the drilling mud. A new type of device must therefore be installed.

The industry therefore developed the Rotating Control Device, known as an RCD, which also operates to close off the annulus around the drill pipe, but is intended to operate while drilling operations are in progress, that is, while the drill pipe is rotating. The sealing element which grips the drill pipe rotates with the drill pipe. While that solves the problem of wear on the inside diameter of the sealing element, the element must now be supported on bearings, and sometimes bearings are installed above and below the sealing element, to aid in the rotation and prevent the element from wearing out. Unfortunately this creates additional problems, because the bearings wear out and must be replaced periodically.

As shown in FIG. 1B, the RCD 114 is installed at the top of the BOP stack 100. Returned drilling fluid and produced hydrocarbons flow up through the BOP stack 100 and are blocked at the top of the BOP stack 100 by the RCD 114. The flow is diverted out through a flow spool 116 and separator 118, where the drilling fluid and produced hydrocarbons and water are separated. The pressure in the BOP stack can be regulated by adjusting the drilling choke 120.

As described above, while drilling is in progress, the ram BOPs 104-110 and annular BOP 112 are not activated. Therefore the pressure of the fluids in the well bore is held in check only by the RCD 114 and the drilling choke 120. This exposes the operators on the rig floor to very high pressures with only the single RCD 114 between them and potential disaster. The location of the RCD 114 is a result of the constraint that in order to replace the bearings for the sealing element, it is necessary to remove the top of the RCD 114. This requires the RCD 114 to be placed on top of the stack.

The returning fluid contains cuttings from the drilling which are removed so that the drilling fluid can be recirculated. It will be obvious to a person of ordinary skill in the art that as the return fluid flows up through the BOP stack 100, the internal mechanisms of the rams 104, 106, 108, 110 and annular BOP 112 will trap and accumulate these cuttings from the continuous return fluid flow. When the need arises to activate the BOP devices, this buildup of detritus, known as "swarf", in their internal cavities may be an impediment to their proper operation. Indeed, there are multiple companies which offer services to periodically clean out this swarf in order to maintain optimal operation of the devices. While that helps with maintenance operations, one has to hope that if the devices have to be activated in an emergency, the swarf contamination does not prevent their effective operation.

A further disadvantage of this approach is seen when the BOP stack devices are activated. If one of the devices below the RCD is activated, and then the pressure in the well drops, there will be a pocket of high pressure fluid in the BOP stack between the two activated devices. If multiple devices are activated, there may be several zones with different pressures. While this is not an insurmountable problem, care must be taken when returning to normal operations. In particular, the order in which the devices are deactivated is important, to avoid a sudden and damaging release of pressure in one of these pockets.

Many of these disadvantages of a conventional underbalanced drilling operation are addressed and overcome by the present invention. The present invention is based on the premise that the well pressure should not be controlled at the top of the BOP stack as is done with the RCD 114 in FIG. 1B. The primary pressure control mechanism in conventional drilling, the mud system, is not employed. The substitute for that primary safety and control system should take its place, that is, below the BOP stack 100. The components of the BOP stack 100 can then function as intended, as a secondary safety and control system.

The present invention comprises an Annular Pressure Control Diverter, designed specifically to be positioned below the conventional BOP stack and function as the primary pressure barrier. This is contrary to conventional practice, where the annular pressure control device, the RCD, is placed at the top of the stack. The present invention does not do away with the traditional RCD and BOP devices because they still serve their usual function as secondary blowout prevention barriers. Substituting a mechanical barrier for the mud system greatly reduces the risk of errors, and provides a reliable system for controlling pressure.

As with the RCD 114, the fluid flow is diverted below the Annular Pressure Control Diverter, but in a very different manner. As explained in detail in the '273 Publication, the purpose of the Annular Pressure Control Diverter is to block the annulus between the drill pipe and the production casing. The return fluid flow is diverted through ports in the production casing aka tie-back liner, into the annulus between the production casing and the intermediate casing. No fluid flows past the Annular Pressure Control Diverter. The pressure above the Annular Pressure Control Diverter in the upper BOP stack is not exposed to formation pressure.

It should be noted that the name Annular Pressure Control Diverter refers to the use of the device to block the annulus between the drill pipe and the production casing, and not to the embodiments described herein which compress an annular seal around the drill pipe by applying pressure from below to reduce the internal diameter of the seal. The objective of sealing the annulus could also be accomplished using a ram type diverter whose seal has been modified to resist torsional forces from rotating drill pipe. Such a device would also provide an annular seal which is compressed to reduce the internal diameter by applying horizontal pressure from the sides to compress the seal. The ram diverter is the subject of a separate patent application by the inventor of the device disclosed herein, specifically, U.S. Provisional Patent Application No. 63/082,059, entitled "Annular Pressure Control Ram Diverter" to William James Hughes.

Figure 2:
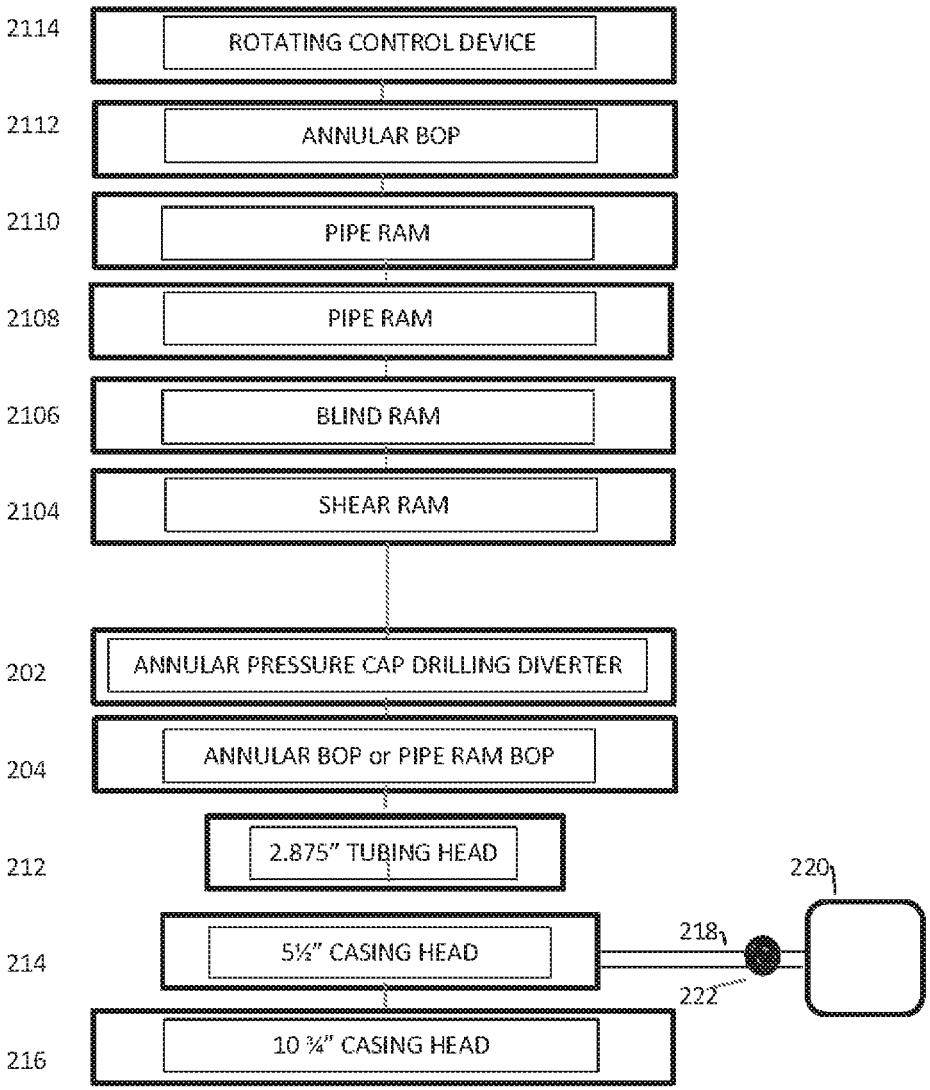
FIG. 2 shows a conceptual diagram illustrating the addition of an Annular Pressure Cap Drilling Diverter as the primary pressure barrier below the conventional BOP stack.

One possible embodiment of the use of an Annular Pressure Control Diverter as a primary pressure barrier is illustrated conceptually in FIG. 2. For clarity, the various components are shown as rectangles. There are many components from multiple different suppliers which can be used in the BOP stack, so FIG. 2 avoids the use of detailed depictions of specific components in order to not show an implied preference for one variation of a component over another.

In FIG. 2, components 2104 through 2114 are the same as components 2014 through 114 previously described and shown in FIG. 1. This set of components, which in conventional drilling is referred to as "the BOP stack", will be referred to in the following description as "the upper BOP stack".

In FIG. 2, the device which is employed as a primary pressure barrier is an Annular Pressure Control Diverter 202. Below the Annular Pressure Control Diverter 202 is shown an annular BOP or pipe ram BOP 204. An annular BOP or pipe ram BOP 204 is needed to isolate pressure from Annular Pressure Control Diverter 202 when changing the seals.

In this and similar embodiments, the flow spool 116 is not required. The return fluid flow is handled differently since pressure and fluid flow are diverted below ground level via a flow line 218 to a four phase separator 220, and below the all-inclusive BOP stack 202-204, 2104-2114, while maintaining the underbalanced condition using a valve 222 to bleed off the excess pressure.

It must be emphasized that there will be no reservoir pressure on the upper BOP stack while drilling using the embodiments described herein. All pressure will be contained below the Annular Pressure Control Diverter 202 while drilling. The present invention brings an additional increase in the safety of the drilling operation, as the Annular Pressure Control Diverter 202 is positioned below the rig floor at ground level. The drilling personnel are thus not working in close proximity to high pressure equipment.

The Annular Pressure Control Diverter described herein is similar in concept to an Annular Blowout Preventer or Rotating Control Device. It is important to note the difference between an Annular BOP and a Rotating Control Device. An Annular BOP is designed to be activated only when the drill pipe is not rotating. An RCD is designed to be activated while the drill pipe is rotating because the seal rotates with the drill pipe using bearings. While the Annular Pressure Control Diverter is similar in concept to these two devices, it functions very differently. Unlike an Annular Blowout Preventer, it is intended to be used while drilling is in progress and while the drill pipe is rotating. Unlike a Rotating Control Device, the seal in the Annular Pressure Control Diverter is specifically designed not to rotate. Further, it is not intended to be used as a backup or secondary safety device, rather, it is located below the BOP stack to be the primary well control barrier.

In an Annular Blowout Preventer, the seal is not normally in contact with the drill pipe and is not subject to wear. The seal in the RCD, and the bearings on which it rotates, will eventually wear and must be replaced. Much of the wear on the seal is not rotational, it happens during tripping of the pipe in and out of the well. Accessing the seal is not a major problem when the RCD is at the top of the BOP stack. Most such devices allow the seal and bearing assembly to be replaced by removing the upper section of the RCD, extracting the worn assembly, and sliding a new annular seal and bearings assembly down into the RCD. However, this is clearly impractical with an Annular Pressure Control Diverter which is intended for use below the conventional BOP stack. It would be necessary to remove the entire upper BOP stack to gain access to the seal through the top of the Annular Pressure Control Diverter.

There are two solutions to this problem. The first may be practical when drilling relatively short lateral wells, for example 2000-3000'. This can be done without changing the Annular Pressure Control Diverter seal, which will last long enough to safely drill the lateral well. It might be possible to use a conventional Annular BOP as an Annular Pressure Control Diverter for drilling a very short lateral, up to a few hundred feet, although these devices are not designed to be used when the drill pipe is rotating and the seal will wear rapidly. The use of a conventional Annular BOP for this purpose is therefore not recommended. It is not possible to use an RCD in this role, because RCDs do not have a top flange, as they are not intended to have other devices installed above them.

The second solution, and by far the preferred embodiment, is to use an improved Annular Pressure Control Diverter which is equipped with side doors, allowing a two-part seal to be removed and replaced without affecting the rest of the BOP stack. Replacing the seal regularly rather than relying on a worn seal to hold back the pressure from the well adds yet another safety factor to the operation. The Annular Pressure Control Diverter described herein uses this approach.

When using underbalanced or near balanced drilling techniques, hydrocarbons can, and will, flow into the well bore, when the pressure in the formation exceeds the pressure exerted by the drilling fluid. The operator must be prepared to deal with the flow of oil or gas, and with these drilling techniques, it is necessary to plan for production of oil and gas, often in significant quantities, during the drilling process. In conventional drilling operations, the returning fluids flow through up through the annulus between the drill pipe and the production tubing and then through the BOP stack. The fluids are diverted to a separator using a flow spool located below the upper RCD. In the current invention, this flow path is not possible because of the presence of the Annular Pressure Control Diverter 202 which blocks the annulus between the drill pipe and the production casing aka tie-back liner. Therefore a different path must be provided for the return fluid flow.

Figure 3:
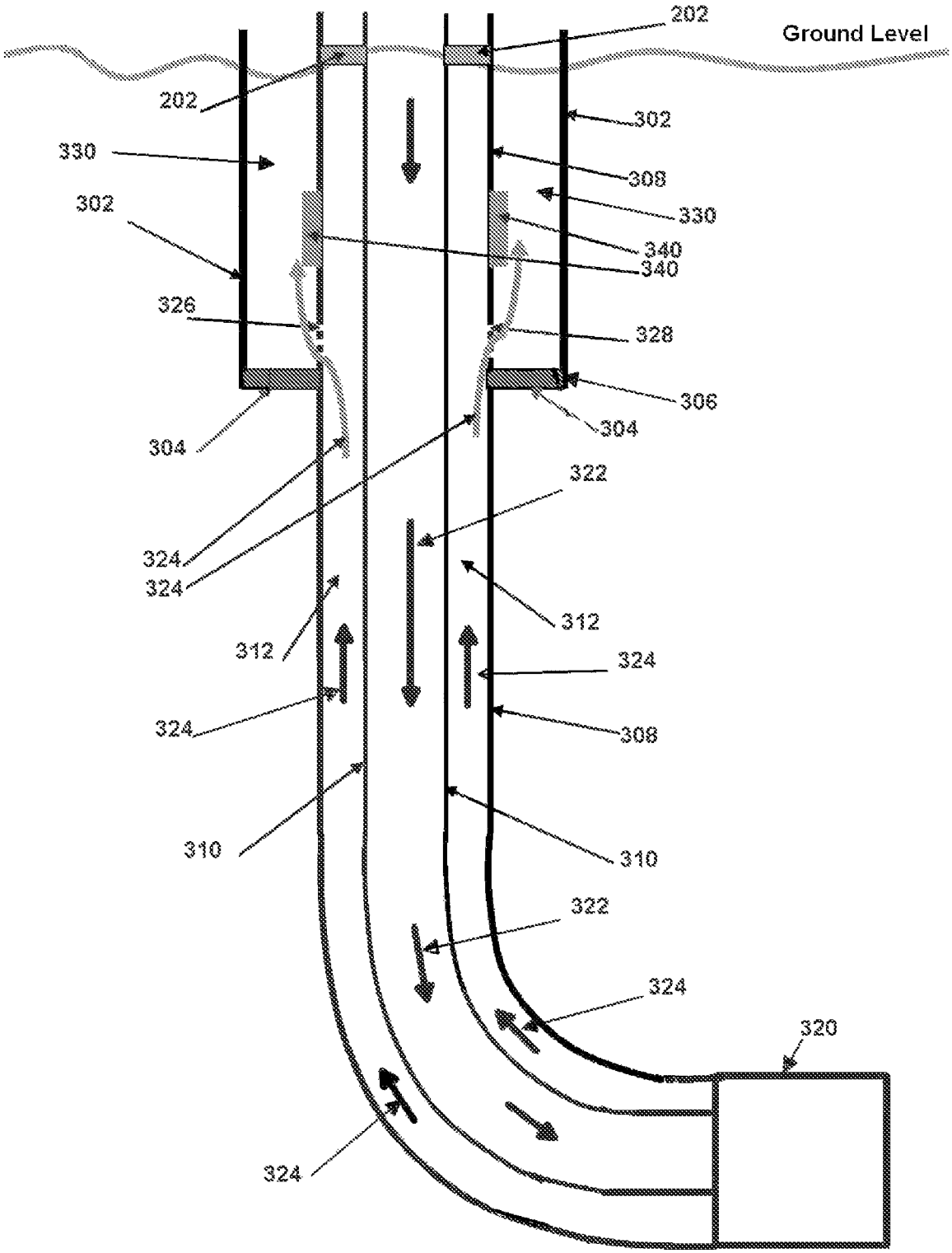
FIG. 3 shows the fluid return flow path when using an Annular Pressure Cap Drilling Diverter as the primary pressure barrier and drilling fluid returns up the annulus between the production casing and intermediate casing.

FIG. 3 is included here for reference and is copied from the '273 Publication for convenience. A full description of how the Annular Pressure Control Diverter is employed to drill a well using the NBRD approach, including how the return fluid flow is diverted, is provided in that application.

As previously shown in FIG. 2, one or more annular BOP or pipe ram BOP 204 are installed below the Annular Pressure Control Diverter 202. This device or devices can be closed to block the annulus 312 in order to change the seals on the Annular Pressure Control Diverter 202. They offer an additional safety factor, as they can be closed as needed to block high pressures in the annulus 312.

This drilling approach thus provides a double level of safety, as now there are two annulars and an upper RCD plus a lower diverter. The upper set is not normally under pressure, and no fluid normally flows through these devices, therefore there is no internal accumulation of detritus which might interfere with their operation. Although the lower annular is under pressure and is normally filled with drilling fluid, there is no fluid flow through these devices because the flow is diverted through the annulus 334. Therefore detritus from the cuttings, or swarf, will not accumulate in the lower annular or pipe ram that is installed below the diverter. This eliminates the need to clean out the BOP stack and remove the swarf, thus reducing costs, and ensures that the devices will not be jammed by the swarf if activated in an emergency.

The present invention also addresses other problems encountered when using an underbalanced drilling approach with conventional equipment in a conventional configuration. One problem particularly seen in shales is formation damage caused in part by the high clay minerals content known as "fines" which can exceed 25% of the total volume of a shale formation. It is expected that there will be production while drilling underbalanced. Pressure will increase at the RCD 114 at the top of the conventional BOP stack 100, and the pressure can be and often is reduced by opening the drilling choke 120. This allows for an increase in the flow of hydrocarbons, and may result in the well being overproduced. The increased flow from the formation causes the migration of fines toward the wellbore, thereby damaging the permeability of the formation proximate to the well bore. All too often, the proposed solution to the drop in permeability is hydraulic fracturing. This makes the problem worse because clay fines are well known for swelling when contacted by water, thus blocking permeability even further.

In the present invention, the annulus 312 is sealed as described above, and the pressure and flow are diverted via flow line 218 to a four-phase separator 220 below ground level, while maintaining the underbalanced condition. Excess pressure buildup can be controlled using the choke valve 222 to bleed off the pressure. This enables production while drilling without the damaging side effects caused by overproducing.

Figures 4A, 4B:
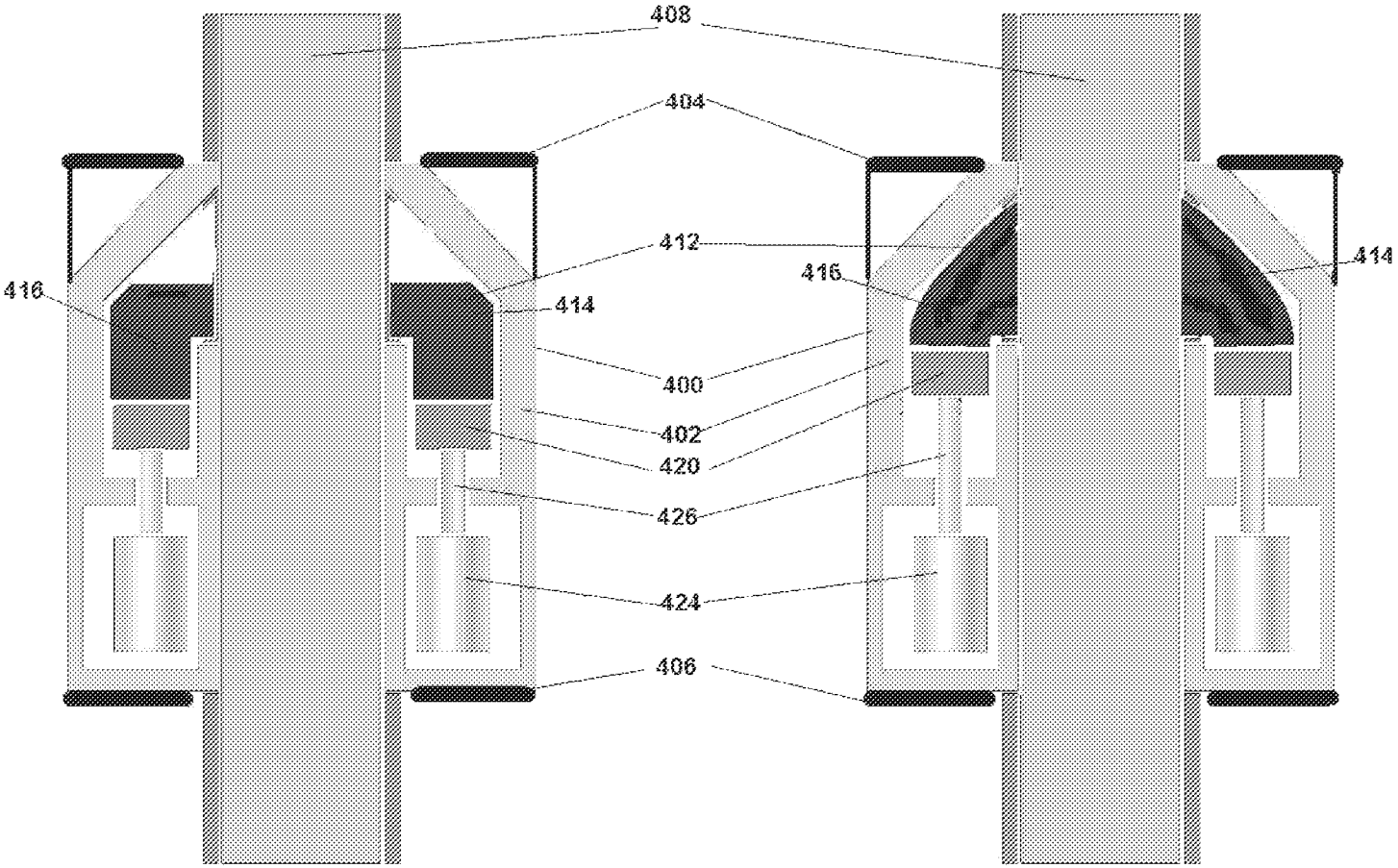
FIG. 4A shows a simplified drawing of an Annular Pressure Control Diverter when not activated.
FIG. 4B shows a simplified drawing of an Annular Pressure Control Diverter when activated during drilling operations.

FIGS. 4A and 4B show a conceptual representation of the Annular Pressure Control Diverter 400, simplified to show the principles on which it operates. FIG. 4A shows the device when it is not activated, FIG. 4B shows the device activated as it would be during drilling operations. The Annular Pressure Control Diverter 400 comprises a cylindrical metal housing 402 capable of withstanding high pressures, up to 5,000 psi.

At the upper end of the cylindrical metal housing 402 is a flange 404. At the lower end of the cylindrical metal housing 402 is a flange 406. Flanges 404,406, have industry standard dimensions and standard holes for fastening the body to other devices or the well casing. The internal diameter of each flange is large enough to permit the passing of drill pipe 408 through the hollow cylindrical body 402, while limiting the vertical motion of the internal components of the Annular Pressure Control Diverter.

The presence of the upper flange 404 distinguishes the Annular Pressure Control Diverter 400 from a conventional RCD. In previous approaches to underbalanced drilling, the RCD is positioned at the top of the BOP stack and therefore does not have an upper flange to allow more devices to be installed above it. The present invention is intended to have a conventional BOP stack installed above it, and therefore has both upper and lower flanges.

The critical component of any annular safety device is the seal. The seal is a flexible component which fits around the drill pipe and grips it, forming a barrier within the annulus around the drill pipe. This barrier prevents the fluids within the annulus from flowing upwards into the upper BOP stack. The high pressure in the well is completely contained below the seal. The pressure in the upper BOP stack is maintained at atmospheric pressure, thus removing the danger to the operators on the drilling floor.

In the present invention, the seal does not rotate, and therefore this device has no need for the bearings which are used in Rotating Control Devices. It is anticipated that the seal will wear during the course of the drilling operation. This is not an issue for several reasons. The wear will be minimal because the seal is made from polyurethane or similar materials, which have shown great resistance to wear, and to some extent are self-lubricating. The device will only be activated when drilling into the reservoir. The Annular Pressure Control Diverter will not be in place during the drilling of the vertical section of the well. Once drilling of the vertical section and the transition curve is complete, the conventional BOP stack is removed and replaced by the BOP stack which includes the Annular Pressure Control Diverter. In most cases drilling the lateral into the productive formation will only take a few days, and the seals will last long enough to accomplish the task.

The seal is constructed as two seal elements which fit together. The surfaces of the seal elements in contact with each other are manufactured with a pattern of raised bumps or nubbins and corresponding depressions such that they interlock securely. When the two parts of the seal are assembled together, they form a toroidal shape, having a center hole through which the drill pipe can pass. The Annular Pressure Control Diverter can accommodate different sizes of drill pipe by changing the seal elements. Given the properties of the polyurethane from which the elements are made, they can accommodate a reasonable range of drill pipe diameter sizes and pipe connection sizes without needing to be changed. Some embodiments of the seal elements are capable of closing down the center hole even with no drill pipe present.

In the embodiment depicted in FIGS. 4A and 4B, the housing 402 contains a toroidal seal 412 which is split into two interlocking seal elements, 414 and 416, made of polyurethane. Polyurethane has properties which make it especially suitable for this application. It is highly compressible, but also has the ability to regain its original shape when the compression is released. It is also highly stretchable, being able to extend in some cases to up to six times its normal dimension and again has the ability to quickly revert to its original shape. It is resistant to wear. Different types of polyurethane have varying resistance to high temperatures, so it is easy to obtain the right type for a given application. And of course, it is not affected by oil and gas.

Seal elements 414 and 416 are supported on a lower spacer 420. A plurality of hydraulic cylinders 424 are arranged around the base of the lower spacer 420. When the pistons 426 of the hydraulic cylinders 424 are extended, they force the lower spacer 420 upwards, compressing the seal elements 414, 416 against the sloping surface 430 inside the housing 402, and tightening the seal elements 414, 416 around the drill pipe 406, as shown in FIG. 4B.

It should be noted that FIG. 4A shows a two dimensional cross-section through the Annular Pressure Control Diverter, and that the seal elements 414, 416 are actually toroidal in shape. FIG. 4B also shows a two dimensional cross-section but the seal elements 414, 416 are drawn to show how they are compressed around the drill pipe 406.

In some embodiments, when the hydraulic pressure in the hydraulic cylinders 424 is lowered, the seal elements 414, 416 revert to their former shape, pushing down the pistons 426 and lower spacer 420. In other embodiments, dual acting pistons are used, so that the pistons 426 pull down the lower spacer 420, allowing the seal elements 414, 416 to revert back to their former shape.

The embodiment of the Annular Pressure Control Diverter shown in FIG. 4 is an example of an active diverter, in that it uses hydraulic pistons to energize the seals. Alternative embodiments are possible, such as a passive diverter which uses formation pressure acting on a tapered seal to squeeze the seal around the drill pipe.

Figure 5:
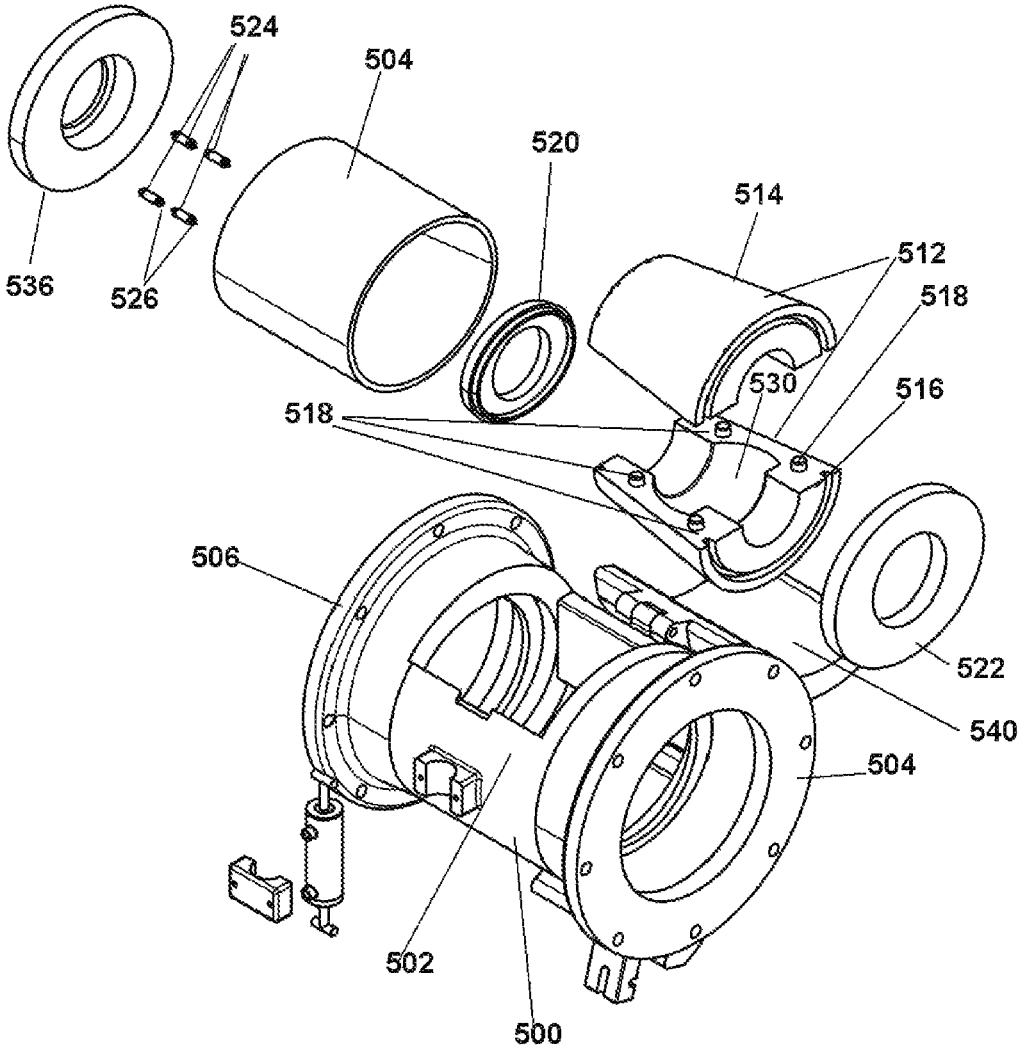
FIG. 5 shows an exploded drawing of one embodiment of an Annular Pressure Control Diverter.

FIG. 5 shows another embodiment in an exploded diagram. This embodiment of the Annular Pressure Control Diverter 500 comprises a hollow cylindrical body 502 made from a high strength material such as steel. The inner wall of the cylinder is vertical when the device is in use In some embodiments, contained entirely within the hollow cylindrical body is a second hollow cylinder, referred to as a wedge 504. The wedge 504 is split vertically into two sections. The wedge 504 moves freely up and down within the hollow cylindrical body 502, its outside diameter being slightly smaller than the internal diameter of the hollow cylindrical body. The internal dimensions of the wedge 504 are smaller at the bottom than at the top, imparting a taper to the inside walls of the wedge 504.

This embodiment also comprises a polyurethane seal 512, split into two interlocking seal elements 514, 516. The surfaces of the seal elements 514, 516 in contact with each other are manufactured with a pattern of raised bumps 518 or nubbins and corresponding depressions such that they interlock securely In some embodiments, the seal elements 514, 516 contain metal inserts to provide additional rigidity and resistance to torsional forces.

In some embodiments, the outer surfaces of the seal elements 514, 516 are equipped with raised ridges which grip the inside of the cylinder in which it is constrained.

In other embodiments, the internal horizontal cross-section of the hollow cylindrical body 502 is an ellipse, and the seal elements 514, 516 have a precisely corresponding elliptical horizontal cross-section, thus preventing them from rotating. The outside of the hollow cylindrical body 502 may be circular or elliptical, or indeed any convenient or desired shape.

At the lower end of the seal elements there is placed a bottom retaining ring 520. At the upper end of the seal elements there is placed a top retaining ring 522.

In some embodiments, there is a cut away section 530 in the middle of the seal elements 514, 516. This allows some relief as a pipe joint passes through the seal elements 514, 516. If it were not for this cut away, the pipe joint would drag on the seal elements 514, 516, deforming them and potentially causing wear and damage.

It should be noted that the present invention is intended to be used together with pipe which has pipe joints significantly smaller than the industry norm. A typical 4" drill pipe may have joints with an external diameter of 5½". Such a large variation in diameter presents a problem when trying to pass the jointed drill pipe through a seal while maintaining a large pressure differential. As part of the overall approach to NBRD of which this device is part, the solution is to use drill pipe with joints having an external diameter no more than 0.5" larger than the drill pipe. When dealing with very large pressure differentials, the use of drill pipe with flush joints may be preferred. Alternatively, the lateral well may be drilled using casing as the drill pipe.

The seal is activated by hydraulic pressure. At the lower end of the hollow cylindrical body is a bottom spacer 536, upon which are installed a plurality of hydraulic cylinders 524. As the pressure in these hydraulic cylinders 524 is increased, the pistons 526 extend vertically and exert pressure on the bottom retaining ring 520. The bottom retaining ring 520 spreads the pressure evenly across the lower ends of the seal elements 514, 516, forcing them upwards against the top retaining ring 522. The seal elements 514, 516 expand inwards to form a tight seal around the drill pipe, blocking the annulus around the drill pipe. This is the normal condition of the device while the lateral well is being drilled. For a full description of how this device is used when drilling a lateral well, see the '273 Publication.

In some drilling operations, it may be necessary to change the seal elements, or to inspect them for safety reasons. As stated above, unlike the RDC at the top of the BOP stack, this Annular Pressure Control Diverter has doors 540 on each side of the hollow cylindrical body 502 which can be opened to remove and insert the seal elements 514, 516 without having to remove any equipment above this device. This can only be done when the pressure inside the Annular Pressure Control Diverter 500 has been released. Doing so requires the operation of downhole safety valves or an annular or pipe ram BOP to isolate the diverter from pressure in the wellbore, to ensure that the pressure within the Annular Pressure Control Diverter 500 can be lowered to atmospheric pressure while maintaining control of the well. Again, for a description of how this is done, see the '273 Publication.

In some embodiments which employ the split wedge 504, the component parts of the split wedge 504 are removed through the doors 540 to allow access to the seal elements 514, 516, and are reinserted after the seal elements 514, 516 have been replaced. In other embodiments, the hollow cylindrical body 502 is sufficiently tall to allow the wedge to be lowered below the doors 540, allowing unimpeded access to the seal elements 514, 516.

The Annular Pressure Control Diverter 500 can be designed to withstand high pressures (5000 psi), and the doors 540 must therefore be as strong as the hollow cylindrical body 502. The mechanism used to attach the doors 540 to the hollow cylindrical body 502 and to ensure that the doors 540 are properly closed and sealed must also be capable of withstanding high internal pressure.

The embodiments described herein also follow a design requirement that the doors 540 and all associated fastening hardware remain attached to the hollow cylindrical body 502 when the doors 540 are opened. This prevents parts such as nuts, bolts etc., from being misplaced or dropped on the ground where they could pick up dirt and contaminants, which might affect their functioning. This feature also makes changing the seal elements 514, 516 easier and faster.

Figure 6:
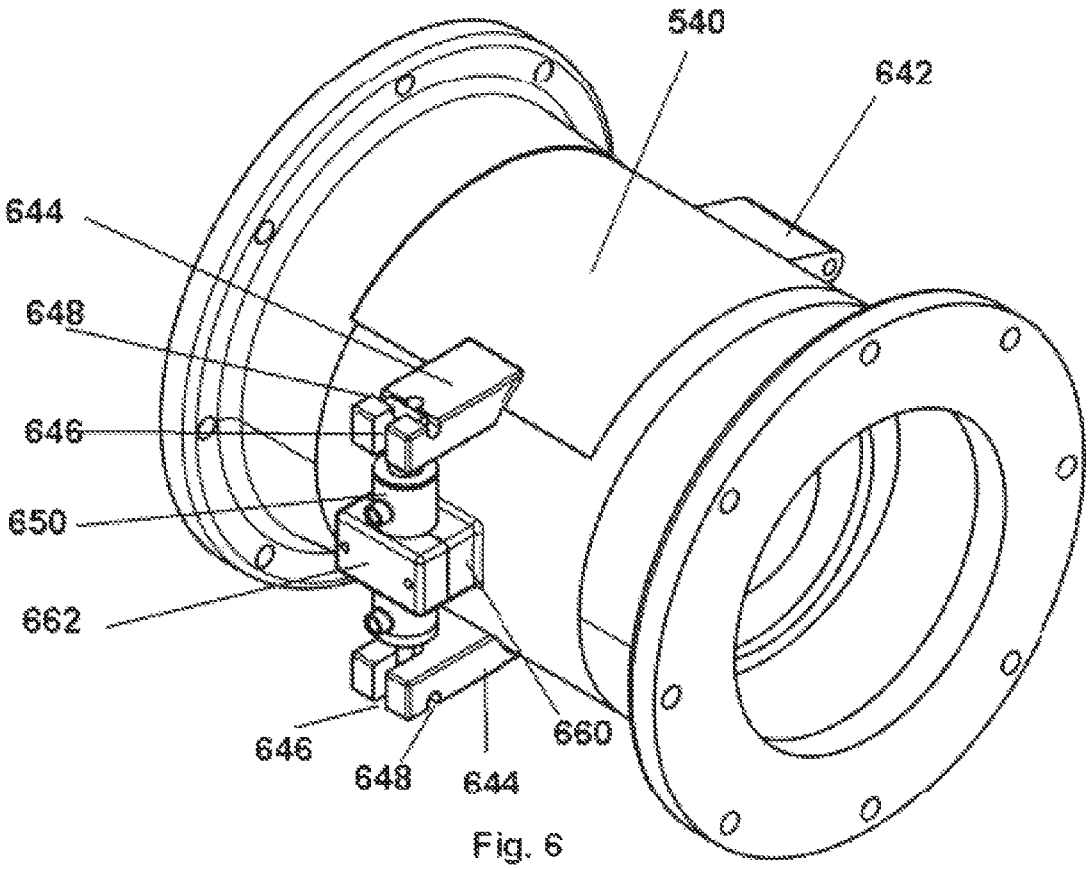
FIG. 6 shows a drawing of an Annular Pressure Control Diverter with side access doors locked by a dual acting hydraulic piston.

In one embodiment, as shown in FIG. 6, each door 540 is equipped with a side-mounted hinge 642. On the other side of the door is a first projection 644 with a horizontal slot 646 and a vertical groove 648. A dual-acting hydraulic cylinder 650 is mounted on a raised section projection 660 of the hollow cylindrical body 502 and is held in position by a clamp 662. The clamp 662 is bolted to the second projection 660 of the hollow cylindrical body 502, and may be removed so that the hydraulic cylinder 650 can be replaced or removed for inspection and maintenance.

At each end of the pistons 664 of the hydraulic cylinder 650 is a metal T-shaped extension 666. When the dual hydraulic cylinders 650 are not pressurized, these T-shaped extensions 666 are horizontal. As the dual cylinders 650 are pressurized, the pistons 664 extend, and the T-shaped extension 666 passes through the horizontal slot 646 in the first projection 644. As the pistons 664 reach the end of their travel, they rotate ninety degrees and retract slightly so that the T-shaped extension 666 fits into the vertical groove 648 on the first projection 644 on the door 540, thus locking the doors 540 together as shown in FIG. 6. The pressure in the hydraulic cylinders 650 can be reduced and the doors 540 will remain locked together. As a safety feature, even if the hydraulic pressure was reduced to zero, or the hydraulic system failed for any reason, the doors 540 would remain locked together. To open the doors 540, the hydraulic system must be pressurized fully to extend the pistons 664 to their maximum extent, pushing the T-shaped extension 666 out of the vertical groove 648 so that they can be rotated to a horizontal position, and then withdrawing the T-shaped extension 666 through the horizontal slot 646.

Figure 7:
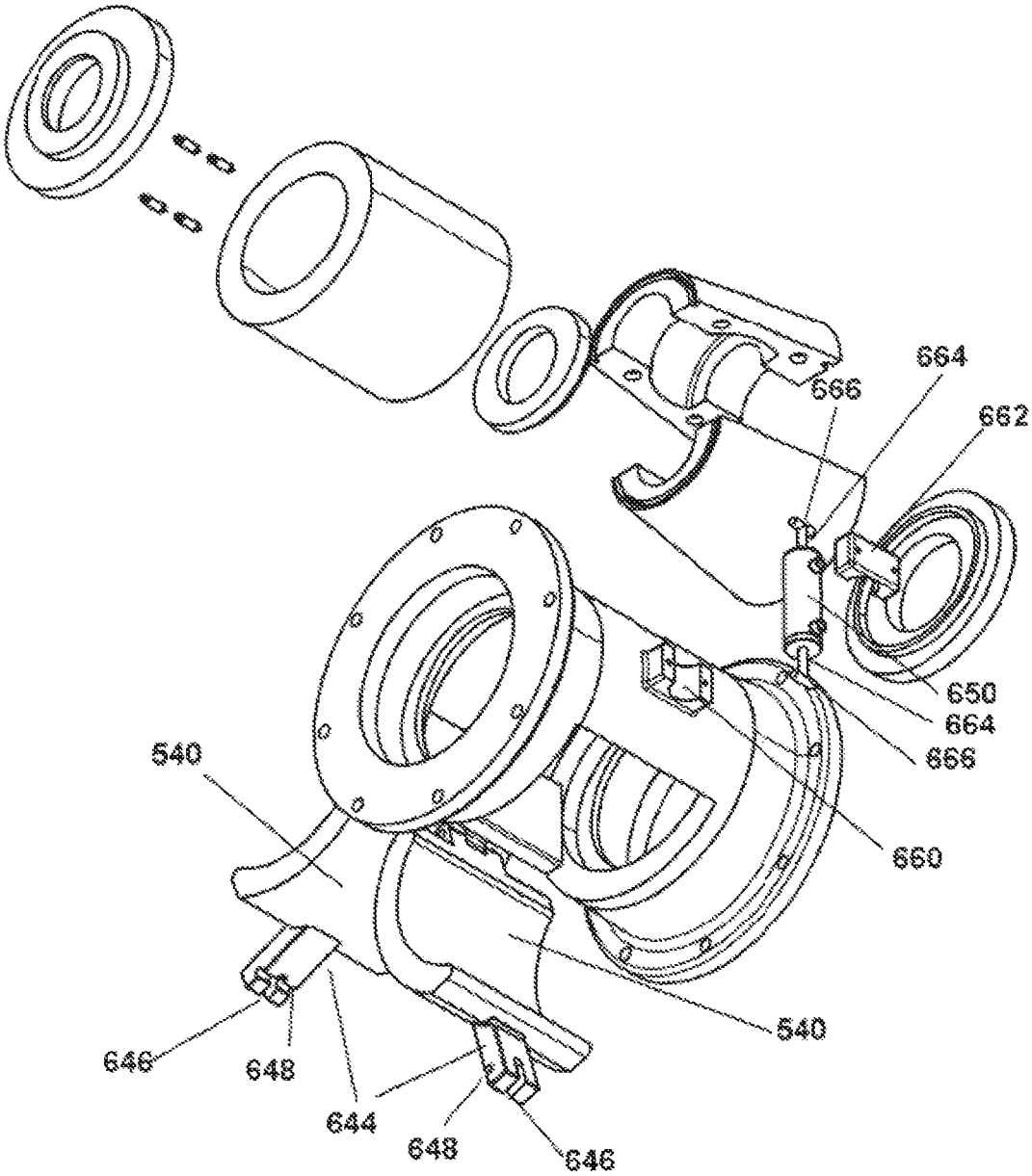
FIG. 7 shows an exploded drawing of an Annular Pressure Control Diverter with side access doors with a dual acting hydraulic piston in the unlocked position.

FIG. 7 shows the exploded view of the Annular Pressure Control Diverter 500 with the parts of the locking mechanism called out.

Figure 8B:
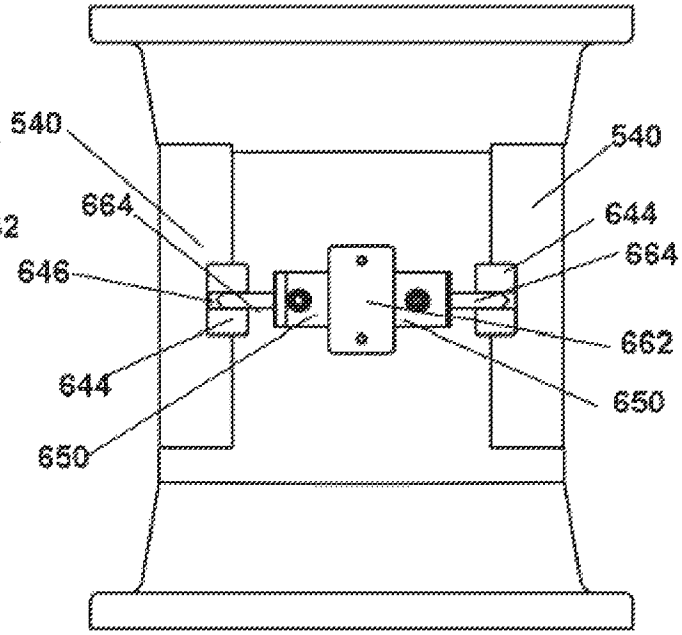
FIG. 8B shows a side drawing of an Annular Pressure Control Diverter with side access doors locked by a dual acting hydraulic piston.
Figure 8A:
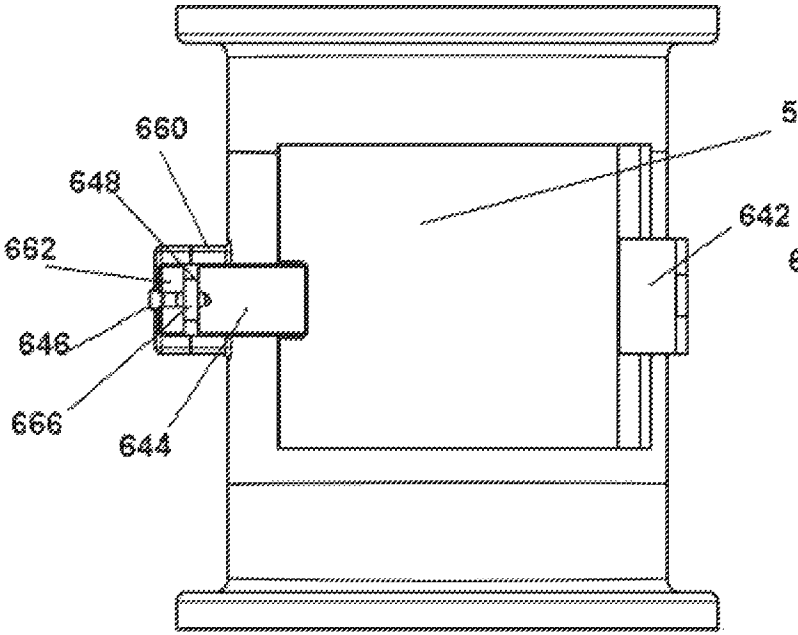
FIG. 8A shows a side drawing of an Annular Pressure Control Diverter with side access doors locked by a dual acting hydraulic piston.

FIG. 8 shows the same embodiment in two views from the side to further illustrate the components described above.

In a variation of this embodiment, some other embodiments employ double hinged doors. The double hinges allow the doors to be pulled straight out and then rotated. Such a design has advantages with thick doors, or when the seals are attached to the inside of the doors.

Figure 9:
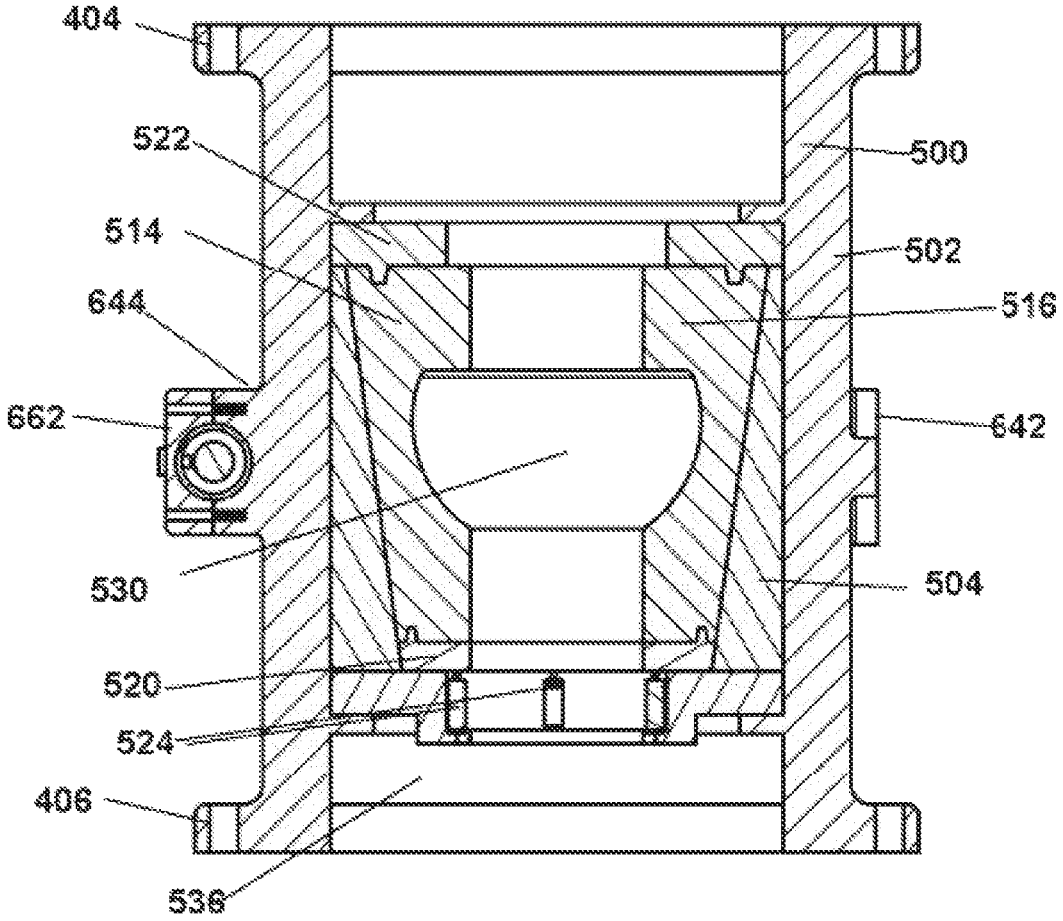
FIG. 9 shows a cutaway drawing of an Annular Pressure Control Diverter with side access doors locked by a dual acting hydraulic piston.

FIG. 9 shows a cross-section through the Annular Pressure Control Diverter 500 showing a different view of the components previously described. Note the absence of bearings such as would be found in a conventional RCD, because the seal elements 514, 516 do not rotate.

Figure 10:
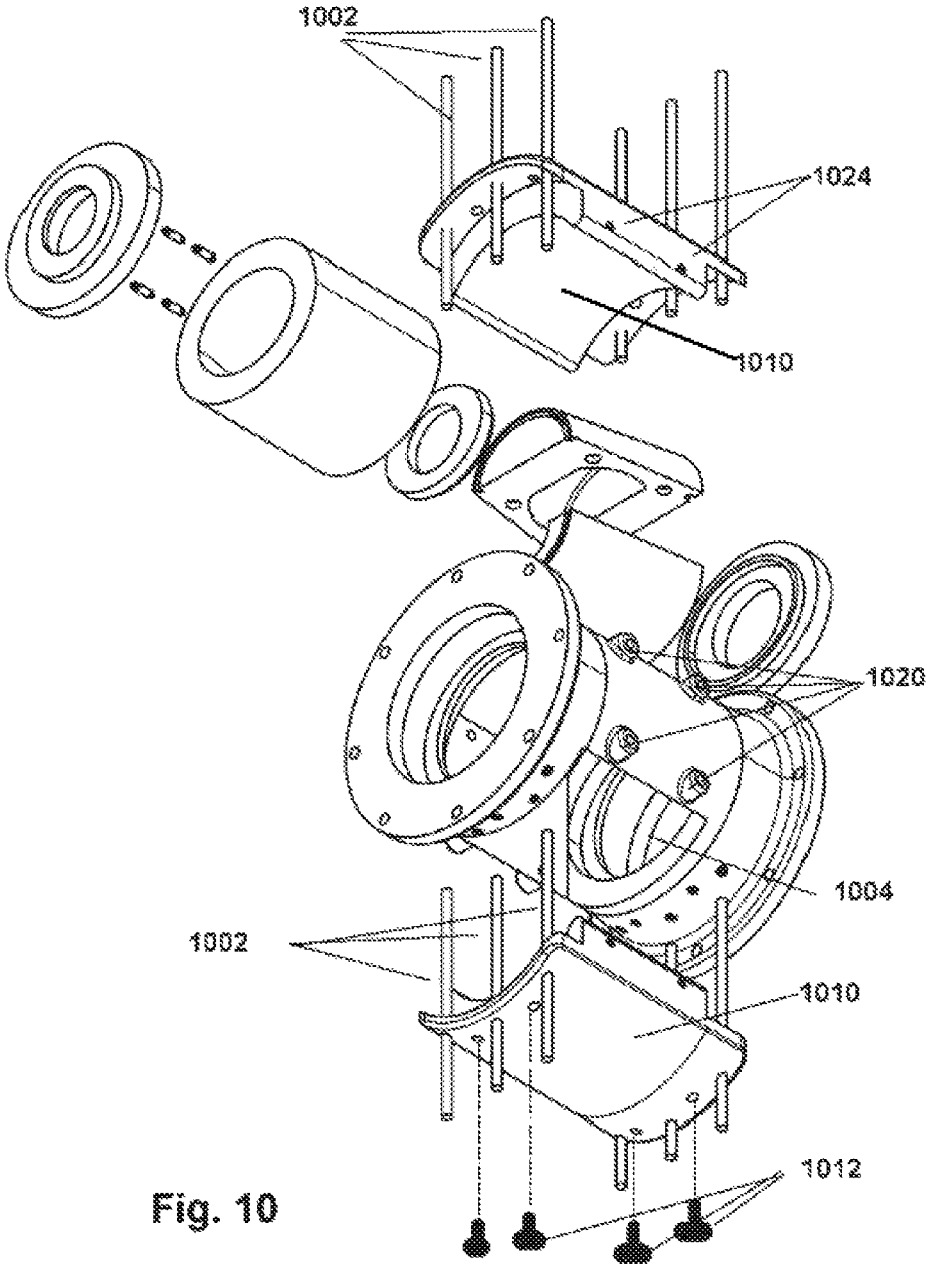
FIG. 10 shows an exploded drawing of an Annular Pressure Control Diverter with side access doors which move on guide rods.

In another embodiment, shown in FIG. 10, a plurality of metal rods 1002 project out from each side of the hollow cylindrical body 502, the metal rods 1002 being located around the openings 1004 in the hollow cylindrical body 502 through which the seal elements 414, 416 are accessed. Doors 1010 fit into and extend beyond these openings 1004 and slide in and out on the plurality of metal rods 1002, with the metal rods 1002 acting as guide rails. In the example shown, the plurality of metal rods 1002 are shown above and below the openings 1004, but could be to each side, or some other convenient configuration. The doors 1010 are secured to the hollow cylindrical body 502 by bolts 1012 which pass through the doors 1010 parallel to the metal rods 1002. This embodiment offers advantages with thick doors, or when the seals 414, 416 are attached to the inside of the doors 1010.

As an additional safety measure, the hollow cylindrical body 502 is fitted with bolt receptacles 1020. Bolts 1022 pass through the bolt receptacles 1020 and screw into corresponding threaded holes 1024 in the sides of the doors 1010, securing the doors 1010 in place. The combination of the bolts 1012 through the outer face of the doors 1010 and the bolts 1022 inserted into the side of the doors 1010 provides assurance that the Annular Pressure Control Diverter 500 can withstand high well head pressures.

The doors 1010 move far enough along the metal rods 1002 to permit access to the openings 1004 and remove and replace the seal elements 414, 416. In some embodiments, the travel of the doors 1010 along the metal rods 1002 is limited, which may be done in some embodiments by installing cap nuts, or nuts threaded onto the metal rods 1002. This ensures that the doors 1010 remain attached to the Annular Pressure Control Diverter 500 and do not become misplaced or contaminated.

Yet another embodiment uses metal rods inside the doors which extend into the hollow cylindrical body when the doors are closed, similar to the locking mechanisms used in safes and bank vault doors.

Figure 11:
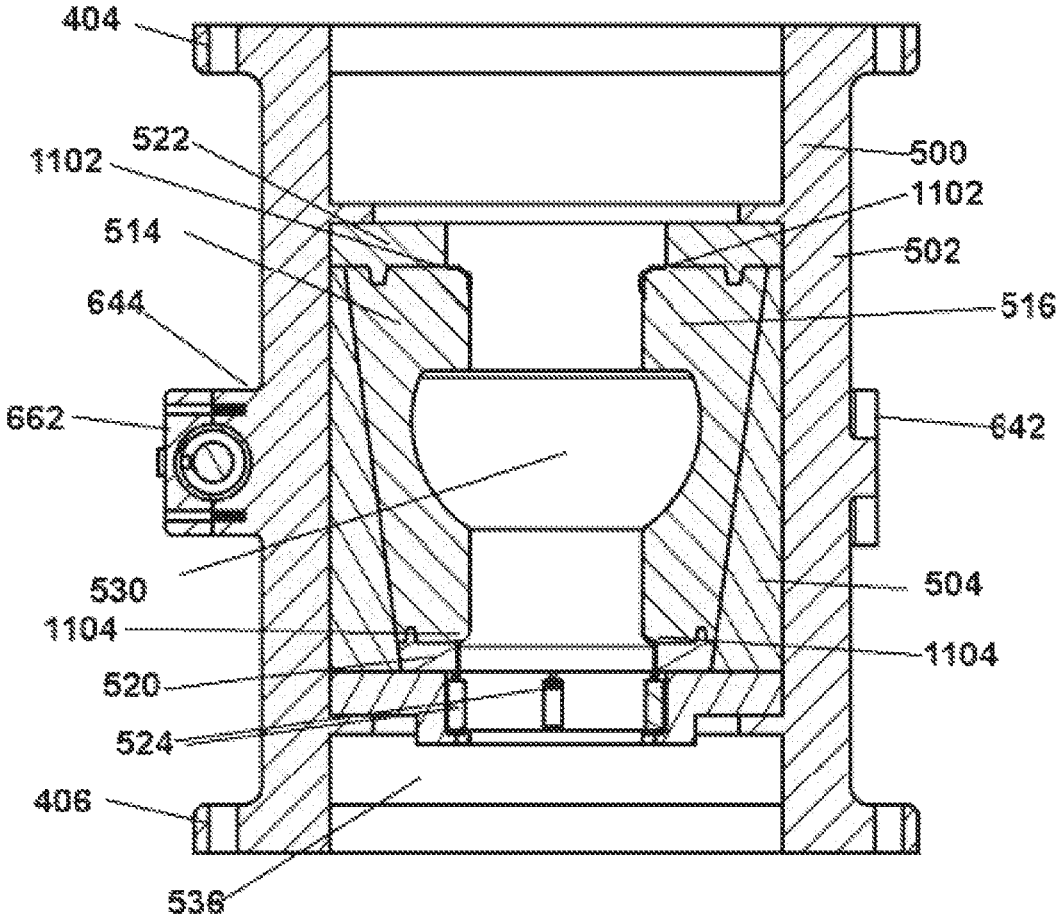
FIG. 11 shows a cutaway drawing of an Annular Pressure Control Diverter with side access doors locked by a dual acting hydraulic piston, with rounded corners on the seal elements.

In some embodiments, the inner surfaces of the seal elements 514, 516 are straight and vertical, as seen in FIG. 5. In other embodiments, as shown in FIG. 11, the inner surfaces of the seal elements 514, 516 have rounded corners 1102 and 1104 at the top and bottom respectively. The rounded corners assist the passage of the drill pipe through the seal. This modification is made because unlike conventional annular devices, the Annular Pressure Control Diverter is intended to be used during the drilling process, when the pipe will be continuously passing down through the device as the drill bit advances. The contours and the degree of curvature on the rounded corners 1102, 1104 may be varied depending on the diameter of the drill pipe and the connections in the drill pipe. Varying the curvature allows for optimum rounding: too little curvature and it does not have much effect on the passage of the drill pipe, too much and the effectiveness of the seal will begin to diminish as the contact area between the seal elements 514, 516 and the drill pipe is reduced.

It will be apparent to one of ordinary skill in the art, having read this specification and studied the drawings, that there are many possible designs which include doors on each side of the Annular Pressure Control Diverter to allow removal and replacement of the seals, and that the embodiments described herein are only provided as examples.

The Annular Pressure Control Diverter may be required to operate under a wide range of conditions, and therefore is designed to be easily customized in the field. The seal elements can be made with different polyurethane compounds with varying levels of compressibility. The dimensions of the seal elements may be varied. The thickness of the walls of the wedge 504 may be changed, and the thickness of the top and bottom retaining rings may be altered. These changes affect the interior volume which can be occupied by the seal elements as they are compressed, and allow the Annular Pressure Control Diverter to accommodate different sizes of drill pipe. These parameters can also be adjusted to configure the Annular Pressure Control Diverter to handle different downhole pressures. The hydraulic cylinders which compress the seal elements can be changed, longer cylinders providing more compressibility, for example.

In addition to the Annular Pressure Control Diverter described herein, additional safety valves, BOPs, RCDs, pipe rams, blind rams and shear rams may also be installed to meet the needs of the drilling operation, company policies, and any applicable safety regulations.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

What is claimed is:

1. An annular pressure control diverter for sealing an annulus between a drill pipe and a production casing surrounding the drill pipe below a blowout preventer BOP stack while rotating the drill pipe in order to divert a flow of returned drilling and produced fluids, comprising:

a cylindrical body having upper and lower flanges to enable installation below the BOP stack;

a flexible seal which compresses around the drill pipe;

the flexible seal further comprising two interlocking flexible seal elements; and two side access doors, one on each side of the cylindrical body, through which the interlocking flexible seal elements may be replaced, wherein the two side access doors open on side mounted hinges; and wherein the two side access doors are secured by a dual horizontal hydraulic piston clamp.

2. The apparatus of claim 1 further comprising:

a projection of each of the two side access doors on the side of the door opposite the side mounted hinge;

a horizontal slot in each projection of the two side access doors;

a vertical groove in each projection of the two side access doors;

the dual horizontal hydraulic piston clamp having two opposing hydraulic pistons with a T-shaped extension on the end of each hydraulic piston wherein the T-shaped extensions to each of the two hydraulic pistons rotate horizontally to pass through the two corresponding horizontal slots in the projections of the two side access doors, then rotate vertically to lock into the two corresponding vertical grooves in the projections of the two side access doors.

* * * * *